United States Patent [19]

Teraoka

[11] Patent Number: 4,761,626

[45] Date of Patent: Aug. 2, 1988

[54] CIRCUIT BREAKER

[75] Inventor: Wataru Teraoka, Niigata, Japan

[73] Assignee: Hitachi, Ltd., Tokyo, Japan

[21] Appl. No.: 812,899

[22] Filed: Dec. 23, 1985

[30] Foreign Application Priority Data

Dec. 26, 1984 [JP] Japan ..... 59-272959

[51] Int. Cl.[4] ..... H01H 75/00; H01H 77/00; H01H 83/00

[52] U.S. Cl. ..... 335/16; 335/147; 335/195; 335/42; 200/147 R

[58] Field of Search ..... 335/16, 195, 147, 38–39, 335/41–42, 176, 8–10, 6, 192, 236; 200/144 R, 147 R; 337/75

[56] References Cited

U.S. PATENT DOCUMENTS

| | | | |
|---|---|---|---|
| 3,056,008 | 10/1962 | Schwartz | 335/38 |
| 3,073,925 | 1/1963 | Thomas et al. | 335/42 |
| 3,118,036 | 1/1964 | Gauthier et al. | 200/147 R |
| 3,171,936 | 3/1965 | Jencks et al. | 200/147 R |
| 3,260,822 | 7/1966 | Stephenson, Jr. | 335/42 |
| 3,500,266 | 3/1970 | Torre | 335/16 |
| 3,758,887 | 9/1973 | Ellsworth et al. | 335/42 X |
| 3,806,847 | 4/1974 | Salvati | 335/42 X |
| 3,855,557 | 12/1974 | Gryctko | 335/42 |
| 4,284,968 | 8/1981 | Denoyelle et al. | 335/42 X |
| 4,470,027 | 9/1984 | Link et al. | 335/16 |
| 4,550,299 | 10/1985 | Bachler | 335/147 X |
| 4,567,455 | 1/1986 | Hosogai et al. | 335/195 X |
| 4,612,426 | 9/1986 | Maier et al. | 200/147 R |

FOREIGN PATENT DOCUMENTS

| | | | |
|---|---|---|---|
| 0031577 | 7/1981 | European Pat. Off. | 337/75 |

*Primary Examiner*—Arthur T. Grimley
*Assistant Examiner*—Jane K. Lau
*Attorney, Agent, or Firm*—Fay, Sharpe, Beall, Fagan, Minnich & McKee

[57] ABSTRACT

In a circuit breaker includes a fixed contactor, a moving contactor subjected to a switching operation of a switching mechanism, a heater connected to the moving contactor and disposed in such a manner as to extend along a fixed core and a moving core pivotally supported by the fixed core, the fixed contactor is formed in a J-shape and is interposed between an insulating member disposed on the fixed contactor in such a manner as to extend along the side of the fixed contactor facing the moving contactor and a demagnetizing member disposed in such a manner as to extend along the bent inner surface. The circuit breaker includes also an operation time adjusting mechanism engaging with the moving core and capable of adjusting the operation time of the moving core, and a casing storing therein the constituent elements. The operation time adjusting mechanism is brought into abutment against an adjustment portion formed on the moving core, and is detachably mounted on the casing.

24 Claims, 15 Drawing Sheets

CIRCUIT BREAKER

BACKGROUND OF THE INVENTION

This invention relates generally to a circuit breaker exhibiting a current limiting effect, and more particularly to a circuit breaker having a construction which is suitable for improving the current limiting effect and assembly workability.

An example of circuit breakers exhibiting the current limiting effect in accordance with the prior art is disclosed, for example, in Japanese Utility Model Publication No. 8132/1982. However, none of the prior art circuit breakers pay specific attention to a construction which elongates an arc length at the time of current limiting, nor to the prevention of an insulating property due to deposition of metals contained in arc gas, nor to the improvement in assembly workability.

Another prior art reference, Japanese Utility Model Publication No. 38859/1972, discloses a construction in which an insulating plate is inserted between a fixed contactor and a moving contactor, but the reference does not definitely teach the shape of the insulating plate and its fitting method. An example of such an insulating plate is described in Japanese Utility Model Laid-Open No. 75965/1979. However, since the insulating plate 107′ is inserted from a transverse direction as shown in FIG. 74 of the accompanying drawings, one of the sides of a fixed contact 103′*a* disposed on a fixed contactor 103′ is always exposed, so that it is difficult to completely cover the portions which are to be insulated.

SUMMARY OF THE INVENTION

It is the first object of the present invention to provide a circuit breaker which has high assembly workability and which exhibits an excellent current limiting effect by fitting an insulating cover to a bent portion of a J-shaped fixed contactor from the side facing a moving contactor, and fitting a demagnetizing plate into a groove formed on the insulating cover in such a manner as to clamp the fixed contactor.

It is the second object of the present invention to provide a circuit breaker which has high assembly workability and is suitable for flexible production by bringing operation time adjusting means, which is disposed in such a manner as to be capable of adjusting the operation time of a moving core, into abutment against an adjustment portion formed on the moving core, and mounting the means removably on a casing.

In a circuit breaker comprising a fixed contactor, a moving contactor subjected to a switching operation by a switching mechanism, a heater connected to the moving contactor and disposed in such a manner as to extend along a fixed core, and a moving core rotatably supported by the fixed core, the first invention of the present application is characterized in that the fixed contactor is bent in a J-shape, and is interposed between an insulating member disposed on the side of the fixed contactor facing the moving contactor in such a manner as to extend along the facing side and a demagnetizing member disposed in such a manner as to extend along the bent inner surface of the fixed contactor.

In a preferred embodiment of the invention, the fixed contactor is equipped at the tip of the bent J-shape with an arc runner at a downward angle from a horizontal direction.

In another preferred embodiment of the invention, the fixed core is formed in a U-shape, a projection is formed at the center on the inner side surface of the U-shape and the heater described above is fixed to this projection.

In still another preferred embodiment of the invention, the switching mechanism includes a fixed frame, a handle lever mounted on the fixed frame, a hook engaging with a trip metal and causing a take-off operation, a link member interposed between the hook and the moving contactor and consisting of upper and lower levers, a lever shaft supporting the upper and lower levers rotatably, and a spring extended between the lever shaft and the handle lever. The handle lever is formed in a U-shape and has arcuate portions at the tips of both sides of the U-shape, and the fixed frame has bearing portions coming into contact with the arcuate portions and a guide portion guiding the end surface of the lever shaft.

In a circuit breaker comprising a fixed contactor, a moving contactor subjected to a switching operation by a switching mechanism, a heater connected to the moving contactor and disposed in such a manner as to extend along a fixed core, a moving core supported rotatably by the fixed core, operation time adjusting means disposed in such a manner as to engage with the moving core and to be capable of adjusting the operation time of the moving core and a casing storing therein all of the constituent members described above, the second invention of the present application is characterized in that the operation time adjusting means comes into contact with an adjustment portion formed on the moving core and its removably mounted on the casing.

In a preferred embodiment of the second invention, the fixed contactor may be bent in a J-shape and interposed between an insulating member disposed on its side facing the moving contactor and a demagnetizing member disposed on the bent inner side.

In another preferred embodiment of the invention, the switching mechanism includes a fixed frame, a handle lever fixed to the fixed frame, a hook engaging with a trip metal and causing a tripping operation, a link member interposed between the hook and the moving contactor and consisting of upper and lower levers, a lever shaft rotatably supporting the upper and lower levers, and a spring extended between the lever shaft and the handle lever. The handle lever is formed in a U-shape and has arcuate portions at the tips of both sides of the U-shape, and the fixed frame has bearing portions coming into contact with the arcuate portions and a guide portion guiding the end surface of the lever shaft.

Due to the constructions described above, the present invention can obtain a circuit breaker which has an excellent current limiting effect and has high assembly workability.

DESCRIPTION OF THE PREFERRED EMBODIMENTS

Figure 72:
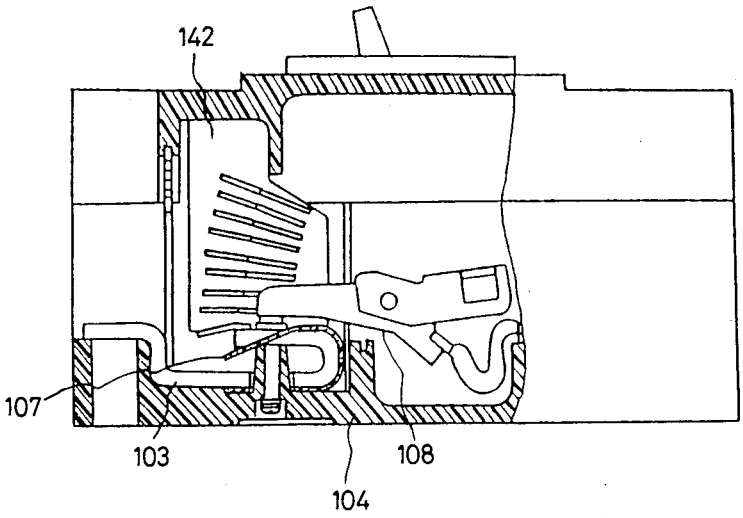
FIG. 72 is a sectional view of the circuit breaker that had been examined before the present invention is completed.
Figure 73:
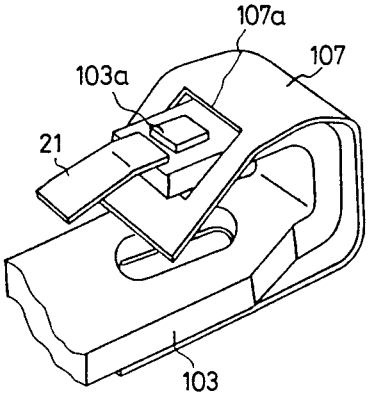
FIGS. 73 and 74 are perspective views showing an insulating cover of the fixed contactor examined before the completion of the present invention and an example of the insulating cover of the fixed contactor in a prior art example.
Figure 74:
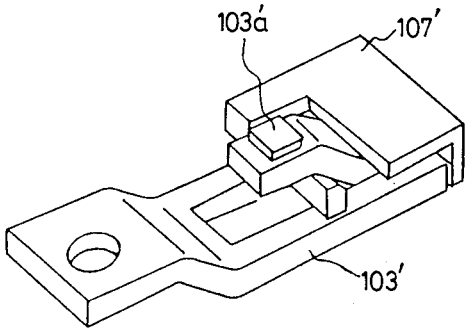

The idea examined before the completion of the present invention is shown in FIGS. 72 and 73. As shown in FIG. 72, a fixed stator 103 is formed in a substantially J-shaped form with one of its ends being bent in a hairpin form. A sheet-like insulator 107 is disposed in such a manner as to extend along the outer periphery of the bent portion, and is fixed to the bottom of a casing 104. A moving contactor 108 is disposed in such a manner as to face the fixed contactor 103, and an arc chute 142 is disposed around the contact.

FIG. 73 shows the fitting state of the insulator 107. An opening 107*a* is formed on the insulator 107 so that the tip of the fixed contactor 103 projects from the opening 107*a* and the fixed contact 103*a* can come into contact with a moving contact (not shown).

According to this idea, the covered area increases but it is difficult to cover the side surfaces. Moreover, many man-hours are required to install the insulator along the bent portion of the fixed contactor 103.

Figure 1:
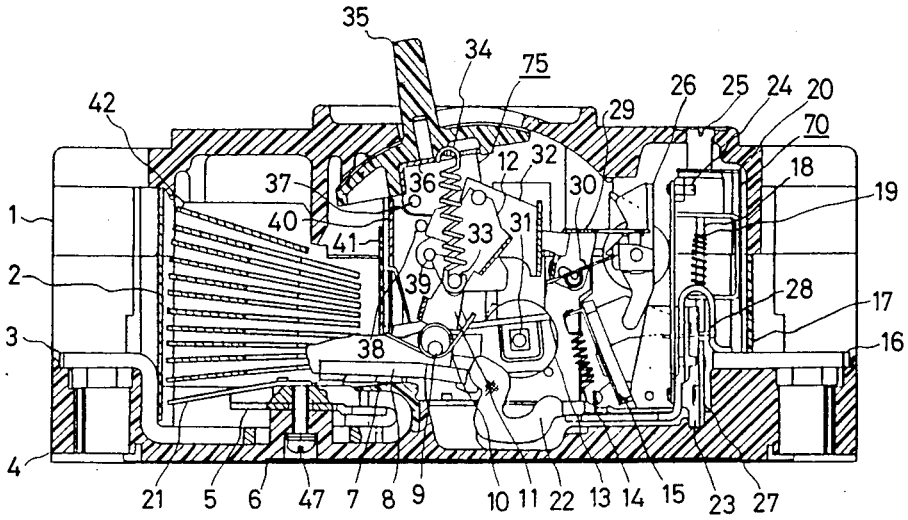
FIGS. 1 and 2 are sectional and plan views of a circuit breaker in accordance with a first embodiment of the present invention.
Figure 71:
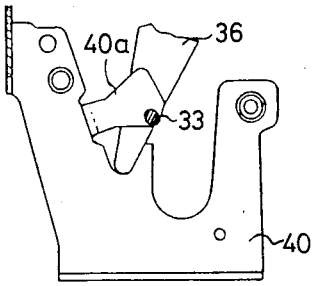

FIGS. 1 through 71 show some preferred embodiments of the present invention.

Figure 2:
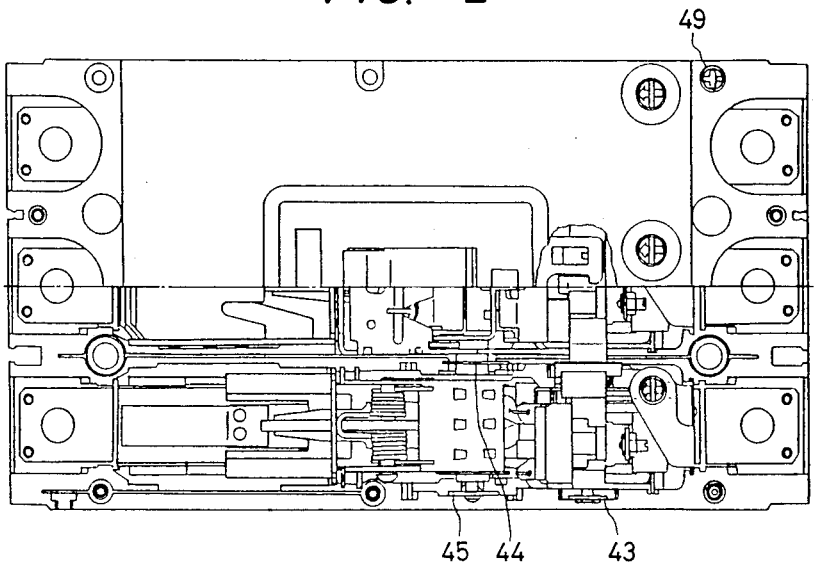

FIGS. 1 and 2 are a sectional view and a plan view of a circuit breaker in accordance with a first embodiment of the present invention.

A contact portion has a fixed contactor 3 and a moving contactor 8, and a secondary side conductor has a heater 28 and a connection terminal 16 disposed on the bottom of a casing 4. A switching mechanism 75 is disposed above the moving contactor 8. This mechanism 75 includes a fixed frame 40, a hook 32 engaging with a trip metal 29, which is anchored to the fixed frame 40 far and causing a tripping operation; a link member consisting of upper and lower levers 12 and 11; a lever shaft 33 pivotally supporting the upper and lower levers 12, 11; and a spring 34 extended between the lever shaft 33 and a handle lever 36. A tripping mechanism is disposed at the intermediate portion between the switching mechanism 75 and the heater 28, and an arc chute 42 is disposed above the contact portion described above. A cover 1 is tightly fitted to the casing 4.

Next, each portion will be described in further detail.

Figure 8:
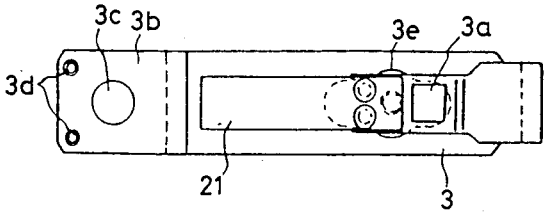
FIGS. 8 and 9 are plan and front views showing the state in which an arc runner is fitted to the fixed contactor.
Figure 9:
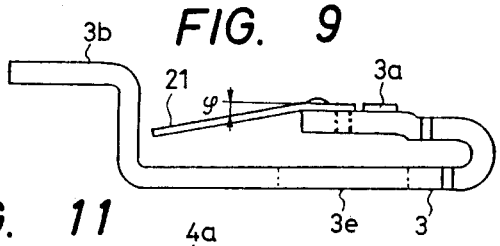

As shown in FIGS. 8 and 9, a terminal portion 3*b* is formed at one of the ends of the fixed contactor 3, and a screw fitting hole 3*c* for fitting a screw (not shown) which fastens a connection terminal (not shown) on the primary side and screw holes 3*d* for fitting the fixed contactor 3 to the casing 4 are bored on the terminal portion 3*b*. The other end of the fixed contactor 3 is bent in a substantially J-shaped form, and a fixed contact 3*a* is fixed by welding or the like to the side of the contactor that faces the moving contactor 8. An arc runner 21 is fixed to the tip of the fixed contact 3*a* by caulking or the like.

Figure 3:
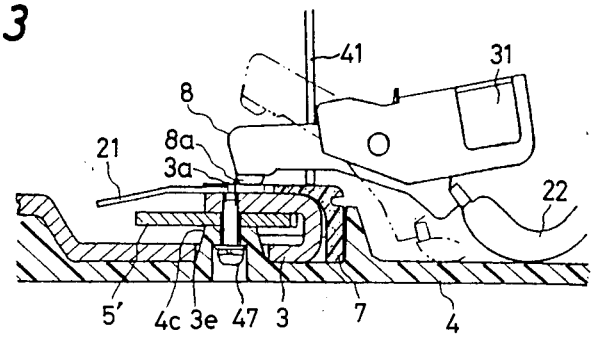
FIGS. 3 and 4 are sectional and perspective views showing an example of the construction in which an insulating cover and a demagnetizing plate are fitted to a fixed contactor.
Figure 4:
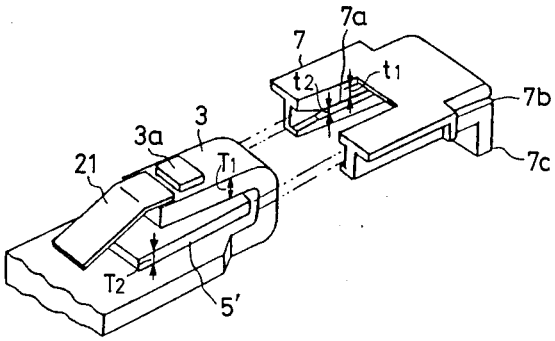
Figure 5:
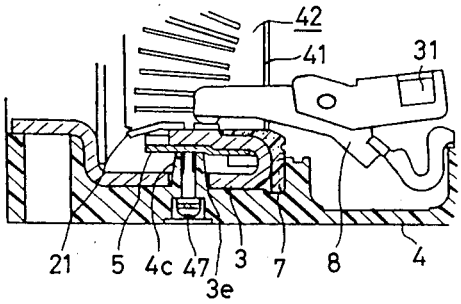
FIGS. 5 and 6 are sectional and perspective views showing the construction in which a demagnetizing plate having a U-shaped cross-section is fitted.
Figure 6:
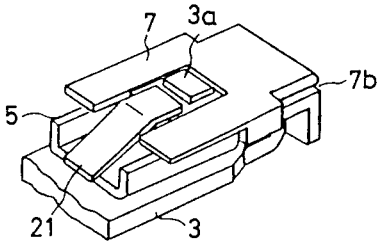
Figure 11:
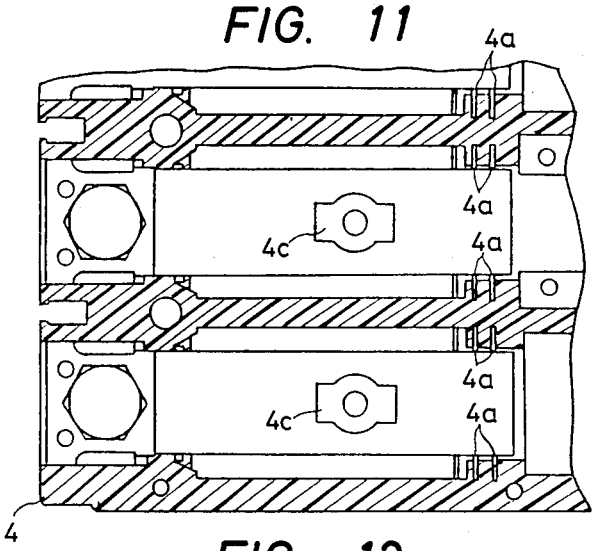
FIGS. 11 and 12 are plan and sectional views showing the fitting portion of a casing for the fixed contactor.
Figure 12:
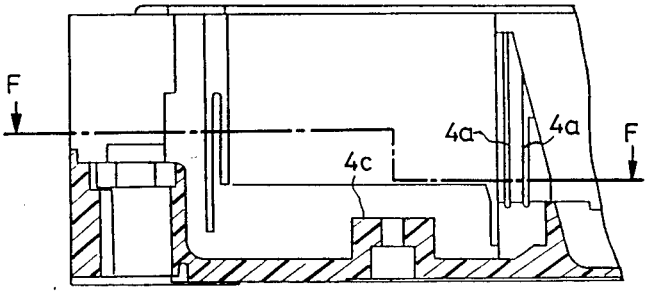
Figure 15:
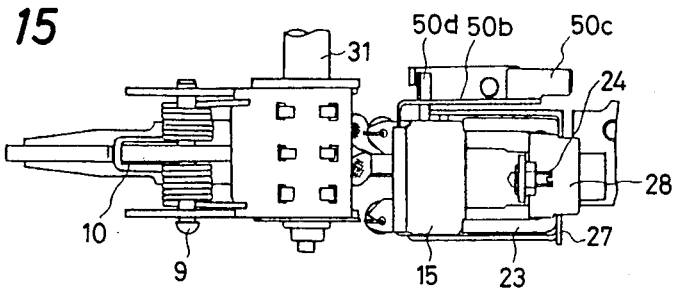
FIGS. 15 and 16 are plan and front views showing the fitting state of the moving contactor, a heater, a fixed core and a moving core.

A fitting hole 3*e* is formed on the lower surface of the fixed contactor 3 and engages with a projection 4*c* (FIGS. 11 and 12) that is formed on the bottom surface of the casing 4. The top of the projection 4*c* is flat as shown in FIG. 12 and comes into contact with the reverse of the J-shaped tip of the fixed contactor 3, that is, the reverse of the surface to which the fixed contact 3*a* and the arc runner 21 are fitted. The fixed contactor 3 is fastened to the casing by a screw 47, as shown in FIG. 1. In this embodiment, the tip of the J-shaped portion of the fixed contactor 3 is clamped by a demagnetizing plate 5 or 5' as a demagnetizing member of magnetic material and an insulating cover 7 as an insulating member. The demagnetizing plate reduces the force of attraction between contactors 3 and 8 due to the current in the moving contactor 8 that is in the same direction as the current flowing through the lower portion of the fixed contactor 3 and can effectively utilize the electromagnetic force of repulsion due to the current in the contactor 8 that is in the opposite direction to the current flowing through the upper portion of the fixed contactor 3. This demagnetizing plate may be a flat sheet-like demagnetizing plate 5' such as shown in FIGS. 3 and 4 or a demagnetizing plate 5 having a substantially U-shaped cross section shown in FIGS. 5 through 7. If the cross-section is U-shaped, the magnetic flux passing through the demagnetizing plate crosses the arc current, drives the arc towards the power source side and extends an arc length, thereby improving the current limiting effect.

Figure 7:
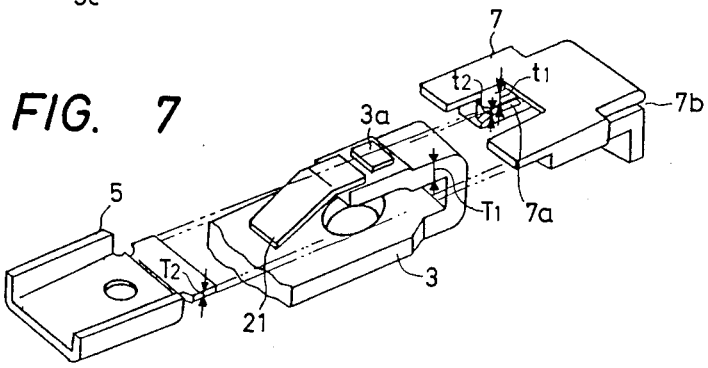
FIG. 7 is a perspective view showing the shape of each component before assembly in FIG. 6.

As shown in FIG. 4, a groove 7*a* is formed on the inner surface of the insulating cover 7, and the width $t_2$ of this groove 7*a* is substantially equal to the thickness $T_2$ of the demagnetizing plate 5'. Moreover, the dimension $t_1$ from the reverse of the insulating cover to the upper end of the groove 7*a* is substantially equal to the thickness $T_1$ of the fixed contactor 3. This arrangement can reliably clamp the fixed contactor 3 between the demagnetizing plate 5 and the insulating cover 7. In the case of FIG. 7, too, the same effect can be obtained as in FIG. 4 if the relation between the width $t_2$ of the groove 7*a* of the insulating cover 7, the dimension $t_1$ from the reverse of the insulating cover to the upper end of the groove 7*a*, the thickness $T_1$ of the fixed contactor 3 and the thickness $T_2$ of the demagnetizing plate are the same as that of FIG. 4.

The arc runner 21 is fixed to the tip of the J-shaped portion of the fixed contactor 3. The arc runner 21 is fixed to the horizontal portion of the fixed contactor 3 with a downward angle $\phi$. This arrangement can increase the number of arc suppressing plates of the arc chute and can also increase the arc length in comparison with the prior art breakers in which the arc runner is disposed horizontally. Therefore, the arc impedance becomes higher, and a greater current limiting effect can be obtained.

Figure 10:
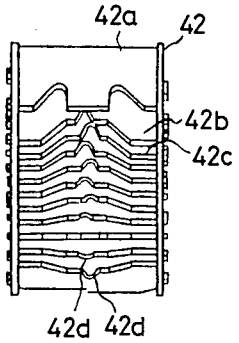
FIG. 10 is a front view showing the shape of an arc chute.

FIG. 10 shows the arc chute 42 in this embodiment. The arc chute 42 has an uppermost arc suppressing plate 42*a* and arc suppressing plates 42*b* and 42*c* etc that are laminated below the plate 42*a* with predetermined gaps between them. A center notch 42*d* is in each of the arc suppressing plates and its position is deviated from that of the adjacent arc suppressing plates so that the arc is caused to run a zigzag, path thereby the arc length can be increased and the arc suppression effect can be improved. In this embodiment, the deviation quantity of the notch 42*d* of the arc suppressing plate 42*b* from the center line is equal to that of the notch 42*d* of the arc suppressing plate 42*c*, in opposite direction. Therefore, when the arc suppressing plate 42*b* is reversed, it can be used as the arc suppressing plate 42*c*, and the kinds of necessary components can thus be reduced.

Figure 13:
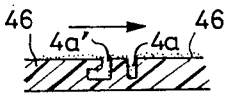
FIGS. 13 and 14 are sectional views showing some examples of the shapes of grooves.
Figure 14:
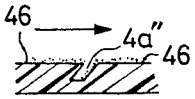

A separator 41 is disposed between the arc chute 42 and the switching mechanism 75 to reduce the quantity of the arc gas that flows into the switching mechanism portion. A groove 4*a* is formed on the wall surface of the casing 4 between the separator 41 and the switching mechanism 75 as shown in FIGS. 11 and 12. Since metal components 46 in the arc gas that are deposited on the wall-surface become discontinuous due to this groove 4*a*, it is possible to maintain insulation resistance. The groove 4*a* may be a L-shaped groove 4*a'* formed in an opposite direction to the travelling direction (arrow) of the arc gas as shown in FIG. 13 or a groove 4*a''* formed in a slantingly opposite direction to the travelling direction (arrow) of the arc gas as shown in FIG. 14. Such shapes can increase the discontinuous portions of the metal components 46 in the arc gas deposited on the wall surface, and insulation resistance can thus be maintained more reliably. The groove may have a combined shape of these grooves.

The conductor on the secondary side from the moving contactor 8 to the contact terminal 16 on the secondary side will be described with reference to FIGS. 15 through 23.

Figure 16:
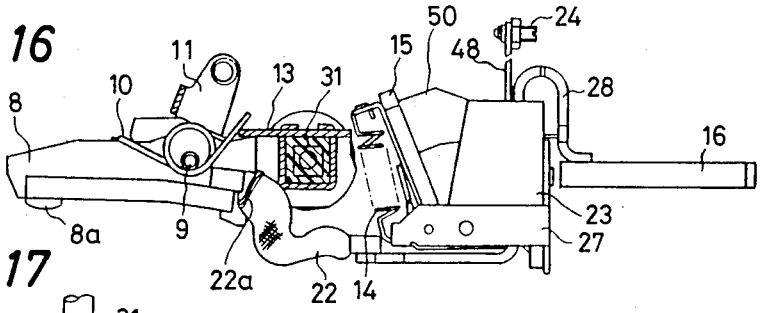
Figure 17:
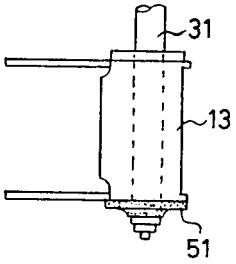
FIG. 17 is a plan view showing the fitting state of a moving frame.
Figure 18:
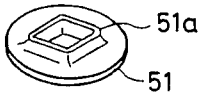
FIG. 18 is a perspective view showing the shape of a separator.
Figure 19:
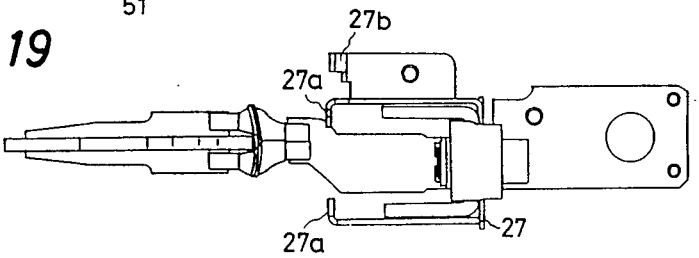
FIGS. 19 and 20 are plan and front views showing the fitting state of the heater, the fixed core and a bemetal.
Figure 20:
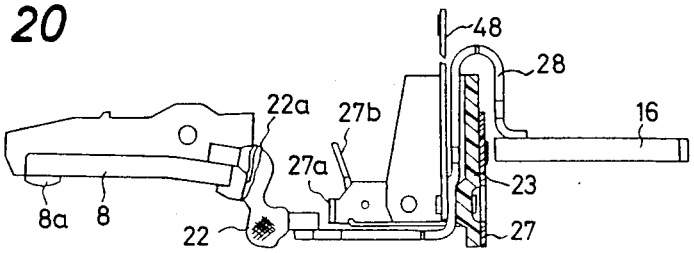

As shown in FIG. 16, the moving contactor 8 is rotatably supported by a shaft 9, and the moving contact 8*a* which is fixed to one of the ends of the moving contactor 8 is urged by a spring 10 so that it comes into contact with the fixed contact 3*a* of the fixed contactor 3 with a suitable contact pressure. The moving contactor 8 is rotatably supported by the shaft 9 to a moving frame 13 fixed to a shaft 31. Since the shaft 31 penetrates through each phase, a switching operation is simultaneously effected for each phase. As seen in FIG. 2, a separator 44 is disposed at the insertion portion of the shaft 31 through each phase, and is supported on the inner wall of the casing 4 via a shaft support 45. A separator 51 is fitted to the end portion of the shaft 31 as shown in FIGS. 17 and 18. The separator 51 is provided with a rise portion 51*a*, which secures an insulation distance and makes insulation more reliable.

The end portion of the moving contactor 8 on the opposite side to the moving contact 8*a* is connected to a heater 28 via a flexible conductor 22. The flexible conductor 22 is generally formed by knitting tinned wires. A magnet wire 22*a* is wound on a portion close to the connection portion of the flexible conductor 22 to the moving contactor 8. This arrangement can prevent breakage of the flexible conductor 22 at its portion where it is brazed to the moving contactor 8 and which is repeatedly bent during the switching operations. The number of windings of the magnet wire 22*a* is suitably from 1 to 5; this embodiment uses two turns.

Figure 21:
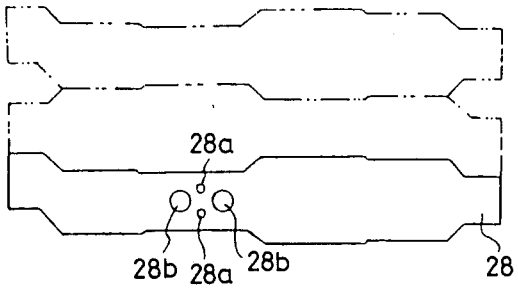
FIG. 21 is a plan view showing the shaping method of the heater from a blank plate.
Figure 22:
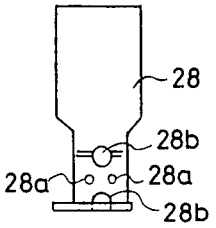
FIGS. 22 and 23 are front and side views of the heater after shaping.
Figure 23:
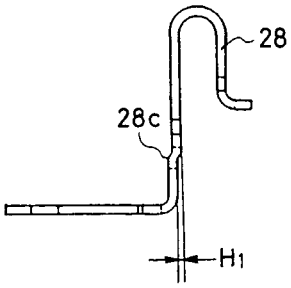

The heater 28 is shaped substantially like the figure "2". A fixed core 23 which is fixed to a core support plate 27 and a bimetal 48 are fitted to the heater 28. As shown in FIG. 21, the heater 28 in this embodiment is equipped around its outer periphery with symmetrical width reductions. This eliminates waste when shaping blank sheets and can improve the production yield. The heater 28 has fixing holes 28*a* and holes 28*b* for absorbing strain at the time of bending. A step portion 28*c* is formed on the heater 28 as shown in FIG. 23, so that the bimetal 48 can be fitted with a predetermined gap with respect to the heater 28 and to the fixed core 23.

Next, the tripping mechanism will be explained with reference to FIGS. 24 through 57.

Figure 24:
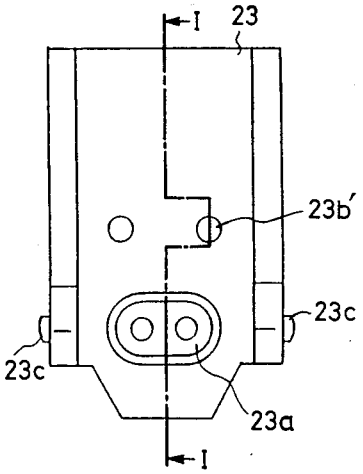
FIGS. 24 and 25 are front and I—I sectional views of the fixed core with section line I—I being shown in FIG. 24.
Figure 25:
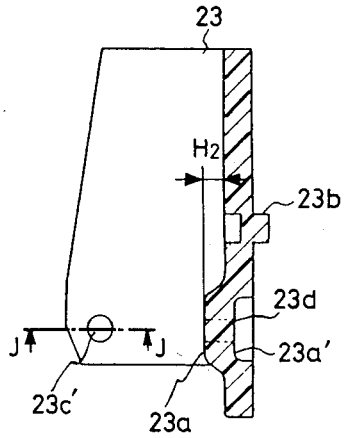
Figure 26:
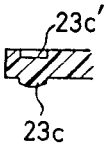
FIG. 26 is an J—J sectional view of FIG. 25.

FIGS. 24, 25 and 26 show the fixed core of an instantaneous take-off device in this embodiment. The fixed core 23 has a substantially U-shaped cross-section. A projection portion 23*a* having a hole 23*d* is formed to project inward on the center side while a projection 23*b* is formed to project outward. Projections 23*c* are formed on both sides of the U-shaped so as to project outward. Since the projection portion 23*a* and the projections 23*b* and 23*c* are shaped by embossing, corresponding recesses 23*a*', 23*b*' and 23*c*' are formed on the reverse.

Figure 27:
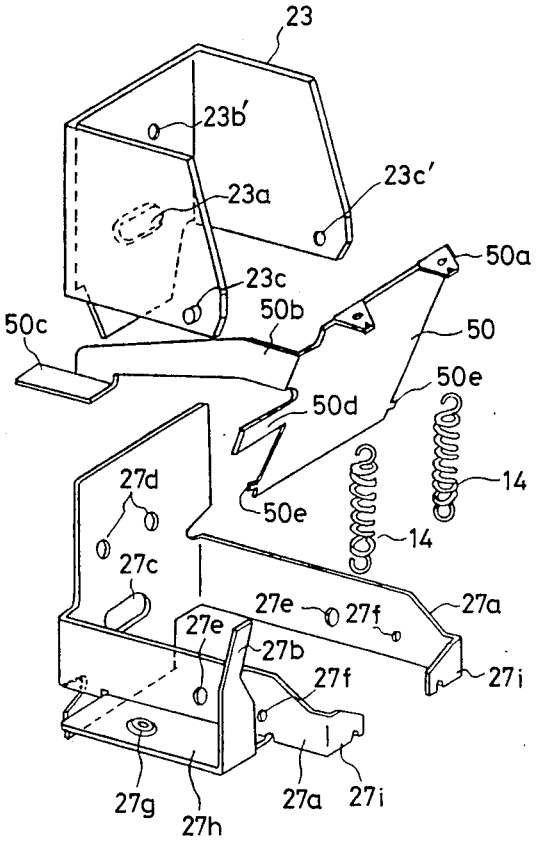
FIG. 27 is a perspective view showing the assembly state of the fixed core, a core support plate and a moving core butting plate of an instantaneous tripping device.

As shown in FIG. 27, a core support plate 27 is formed in such a manner as to hold the fixed core 23, and the projections 23*b* and 23*c* of the fixed core 23 are fitted to the holes 27*d* of the core support plate 27 and to the holes 27*e* of the arms 27*a* of the core support plate 27, respectively. Furthermore, these projections 23 b and 23*c* are caulked so as to fix the fixed core 23 to the core support plate 27. Each arm 27*a* is equipped further with a hole 27*f* through which a support shaft portion 50*e* of a moving core butting plate 50 is inserted. A spring 14 is stretched between the bent portion 27*i* at the tip of each arm 27*a* of the core support plate 27 and the bent portion 50*a* of the moving core butting plate 50. A stopper 50*d* is disposed on the moving core butting plate 50 in such a manner as to butt against another stopper 27*b* formed on the core support plate 27 and to stop the moving core butting plate 50 at a predetermined position. An arm 50*b* is formed on the moving core butting plate 50, and an adjusting portion 50*c* is formed at the tip of this arm 50*b*.

A fitting seat 27*h* is formed on one of the arms 27*a* of the core support plate 27 and is equipped with a screw hole 27*g* for fixing the arm to the bottom surface of the casing 4. A hole 27*c* is bored on the core support plate 27 at a position corresponding to the recess 23*a*' on the reverse of the projection portion 23*a* of the fixed core. The bimetal 48 is fixed to the projection portion of the fixed core 23 through the heater 28. The rise dimension $H_1$ of step 28*c* of the heater 28 and the rise dimension $H_2$ of the projection portion 23*a* of the fixed core 23 are formed in such a manner as to satisfy the relation $H_1 < H_2$. Therefore, the bimetal 48 comes into contact with the heater 28 and with the fixed core 23 only at the fixing portion, and the heater 28 also comes into contact with the fixed core 23 only at the fixing portion. This arrangement minimizes the escaping heat from the heater 28 to the fixed core 23 and can effectively heat the bimetal 48. In addition, since the movement of the bimetal 48 is not restricted, the detection accuracy of an over-current can be improved. Since the projection portion 23*a* is formed by embossing thereby to form the recess 23*a*' on the reverse, the length of pins or rivets for fixing the heater 28 and the bimetal 48 may be small, and the cost of the material can be reduced.

Figure 29:
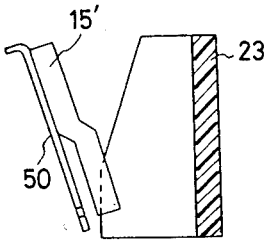
FIGS. 29 and 30 are side views showing some modified shapes of the moving core.
Figure 30:
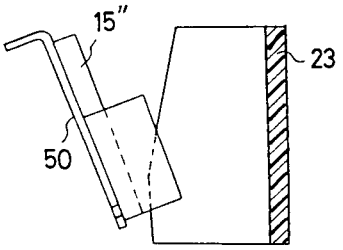

The moving core 15 is fixed to the moving core butting plate 50 by spot welding, screwing, caulking, or the like. As shown in FIGS. 29 and 30, the moving core may be a moving core 15' having a step portion, or a moving core 15" having a bent portion. Such an arrangement can increase the force of attraction by the fixed core 23.

Figure 32:
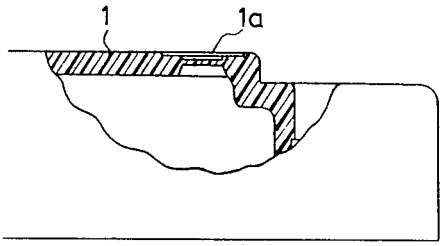
FIG. 32 is a partial sectional view when a reduced thickness portion is formed at the fitting position of the casing for the instantaneous operation adjusting mechanism.
Figure 33:
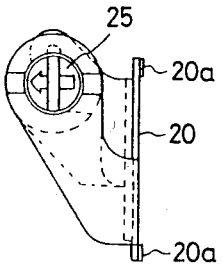
FIGS. 33, 34 and 35 are plan, front and side views of the instantaneous operation adjusting mechanism.
Figure 34:
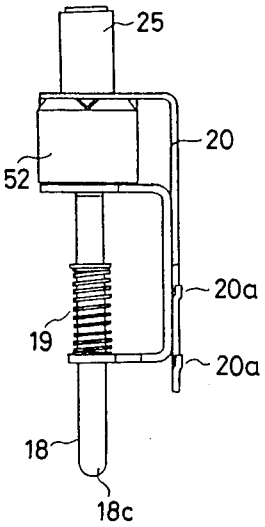
Figure 35:
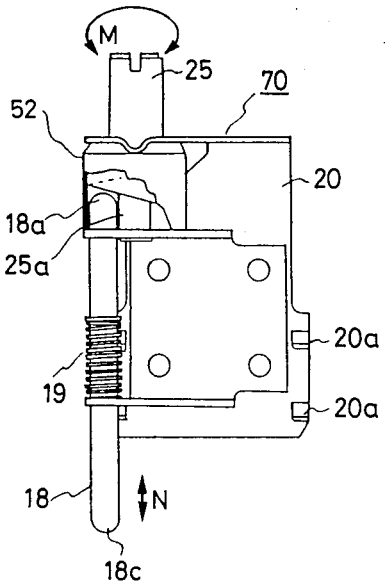
Figure 36:
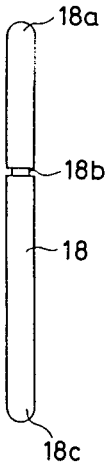
FIG. 36 is a front view of the rod.

The moving core 15 and bimetal 48 having the constructions described above, respectively, are mounted in the casing so that either of them is operated a relay shaft 26 in the same direction. In other words, when a current which is extremely greater than the rated current flows, the moving core 15 is attracted to the fixed core 23 and comes into contact with the instantaneous detection butt portion 26*d* of the relay shaft 26, thereby rotating the relay shaft 26 counterclockwise in the drawing, FIG. 28. When an overcurrent with respect to the rated current flows, the bimetal 48 is heated by the heater 28 and is bent counterclockwise, so that the tip of the bimetal 48 pushes the overcurrent detection portion of the relay shaft 26 and rotates the relay shaft 26 counterclockwise. An adjusting screw 24 is disposed at the tip of the bimetal 48 so as to make fine adjustment of the operation. When an adjustment mechanism 70 of FIG. 37 as an operation time adjustment device for the instantaneous operation is not disposed, the circuit breaker of the invention is completed as a product under the state shown in FIG. 31. In this case, it is also possible to form a reduced thickness portion 1*a* on the cover 1 as shown in FIG. 32 so that the reduced thickness portion 1*a* can be broken when the adjustment mechanism 70 is later mounted.

The adjustment mechanism 70 consists of includes a knob 25, a cover 52, a support plate 20, a rod 18 and a spring 19 as shown in FIGS. 33 through 36. The knob 25 is equipped at its lower part with a helical slope 25*a*, and is rotatably supported by the support plate 20. The rod 18 is fitted into the support plate 20 and is urged by the spring 19 so that its upper end portion 18*a* comes into contact with the slope 25*a*. The spring 19 is held between an E-ring or the like anchored into the groove 18*b* of the rod 18 and the support frame 20.

The cover 52 is disposed around the outer periphery of the slope 25*a* and prevents the intrusion of foreign matter into the gap between the slope 25*a* and the tip 18*a* of the rod. Since the adjustment mechanism is constituted as described above, the rod 18 can be slid in a direction represented by an arrow N when the knob 25 is rotated in a direction represented by an arrow M.

Figure 37:
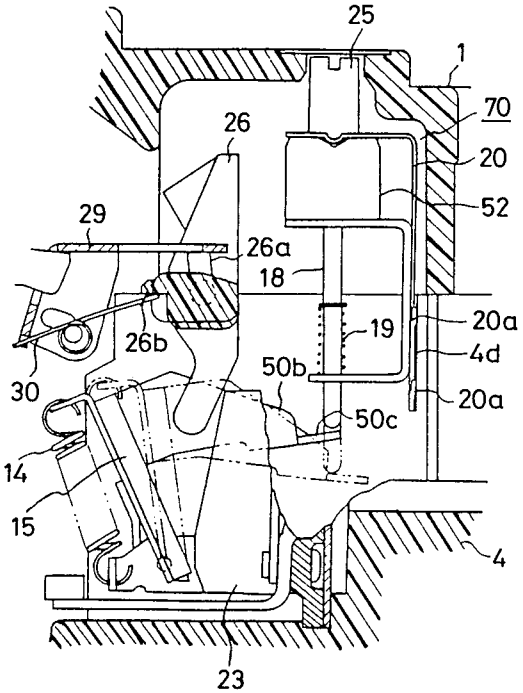
FIG. 37 is a sectional view of the tripping mechanism when the instantaneous operation adjusting mechanism is fitted in the embodiment.

Cut-up portions 20*a* are disposed at both ends of the support plate 20 and prevents the fall-off of the support plate 20 when it is inserted into the groove 4*d* of the casing 4. Since the adjustment mechanism is integrated and fitted removably to the casing, the workability can be improved at the time of assembly and maintenance and inspection. FIG. 37 is a sectional view showing the state in which the adjustment mechanism of this embodiment is assembled into the casing. The adjustment mechanism is fixed to the casing 4 because the support plate 20 is fitted into the groove 4*d* of the casing 4. The reduced thickness portion 1*a* of the cover 1 is removed, and the knob 25 is disposed so as to be operated from outside. The lower end 18*c* of the rod 18 comes into contact with the adjusting portion 50*c* of the moving core butting plate 50. When the knob 25 is rotated, the rod 18 is slid up and down. Since the adjusting portion 50*c* is moved up and down, the initial position of the moving core 15 changes, thereby making it possible to adjust the instantaneous characteristics.

Figure 38:
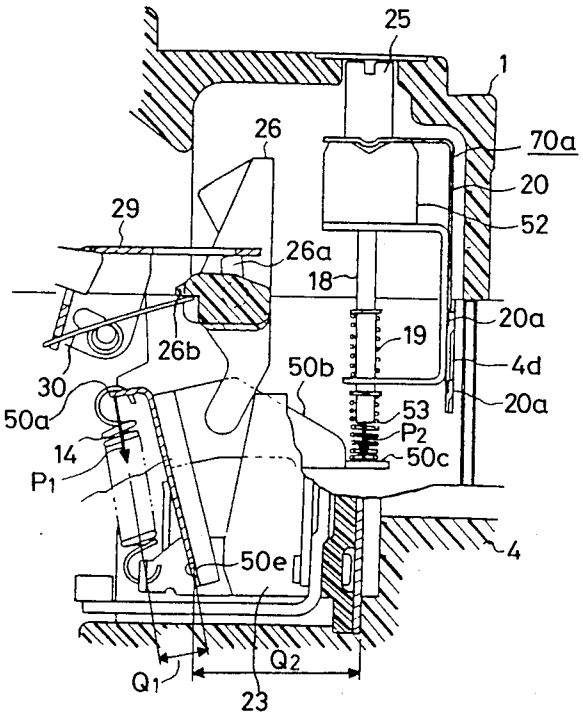
FIG. 38 through 41 are sectional views showing modified examples of the instantaneous operation adjusting mechanism.

FIG. 38 shows a modified example of FIG. 37. An adjustment mechanism 70*a* is shown in this drawing. This mechanism changes the return force of the moving core by the compressive force of the spring 53. In connection with the moment relating to the pivot portion 50*e* of the moving core butting plate 50, the moment m which returns the moving core 15 is given by the following equation:

$$m = P_1Q_1 - P_2Q_2 \quad (1)$$

where $Q_1$: distance from the pivot portion 50*e* to the position where the spring 14 is anchored on the bent portion 50*a*.

$P_1$: the force applied by the spring 14 to the bent portion 50*a*, $Q_2$: distance from the pivot portion 50*e* to the position of the adjusting portion 50*c* at which the spring 58 comes into contact, and $P_2$: the force applied by the spring 53 to the adjusting portion 50*c*.

When $P_2=0$ and $P_2=P_2max$ at the position at which the knob 25 is Hi and at the position at which the knob 25 is Lo, respectively, the m value becomes $P_1Q_2 \leqq m \leqq P_1Q_1 - P_{2max}Q_2$ between the knob positions of from Hi to Lo, so that continuous adjustment becomes possible.

The vertical sliding of the rod 18 by the rotation of the knob 25 may be either continuous or incremental, the latter being effected by disposing a click or clicks on the slope 25*a*.

Figure 39:
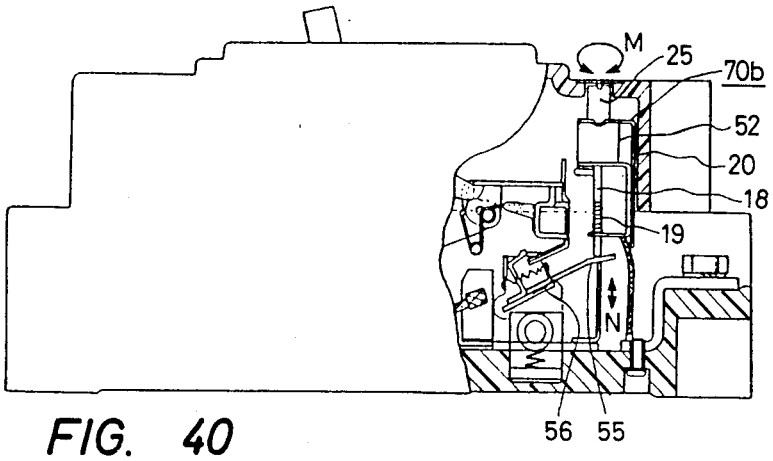

Besides the example described above, the adjustment mechanism can be also applied to the instantaneous adjustment of the moving core using other systems. An adjustment mechanism 70*b* shown in FIG. 39 illustrates an example in which the moving core 56 is attracted downward by a large current. The adjusting portion 55 disposed on the moving core 56 butts against the lower end of the rod 18, and when the knob 25 is rotated in the direction represented by the arrow M, the adjusting portion 50 is moved up and down in the direction of the arrow N so as to make the adjustment.

Figure 40:
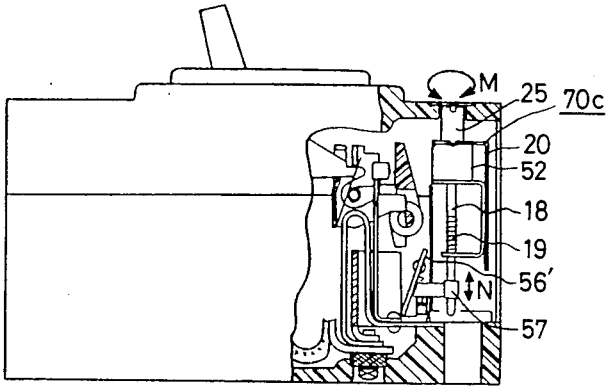

An adjustment mechanism 70*c* shown in FIG. 40 illustrates an example in which the moving core 56' is disposed on the side of the connection terminal on the secondary side. A cam 57 having one of its ends striking the moving core 56' is fixed to the lower end of the rod 18, and when the knob 25 is rotated in the direction of the arrow M, the cam 57 is moved up and down in the direction of the arrow N, thereby changing the gap between the moving core 56' and the fixed core.

Figure 42:
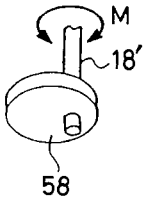
FIG. 42 is a perspective view showing the shape of an eccentric cam in FIG. 41.
Figure 41:
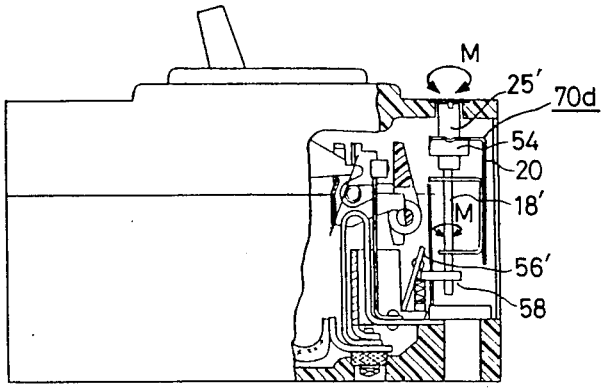

An adjustment mechanism 70*d* in FIG. 41 is a modified example of FIG. 40. The knob 25' is pivotally supported by a bearing 54 so as to transmit the rotation to the rod 18'. In this example, the knob 25' and the rod 18' are directly connected to each other, but a reduction gear such as a gear may be interposed between them. An eccentric cam 58 is fitted to the lower end of the rod 18' as shown in FIG. 42 in such a manner that its end surface strikes the moving core 56'. When the knob 25' is rotated in the direction of the arrow M, the cam 58 rotates in the direction of the arrow M in the same way as the knob 25' and changes the gap between the moving core 56' and the fixed core.

Figure 28:
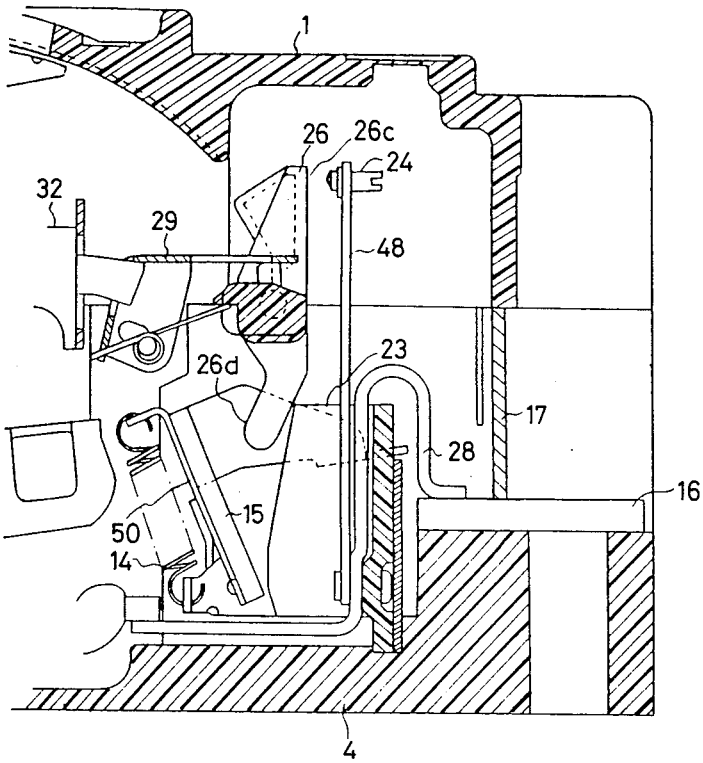
FIG. 28 is a sectional view showing the tripping device as a whole.
Figure 31:
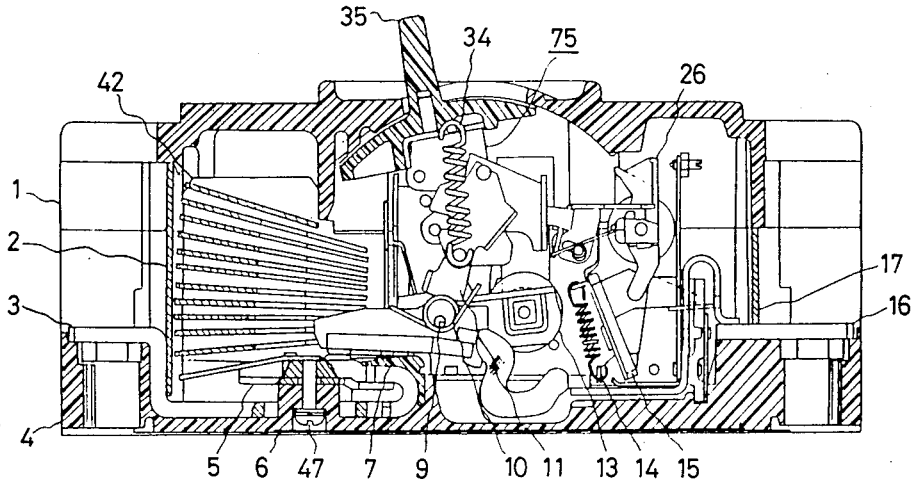
FIG. 31 is a sectional view of the circuit breaker when an instantaneous operation adjusting mechanism is not disposed.
Figure 43:
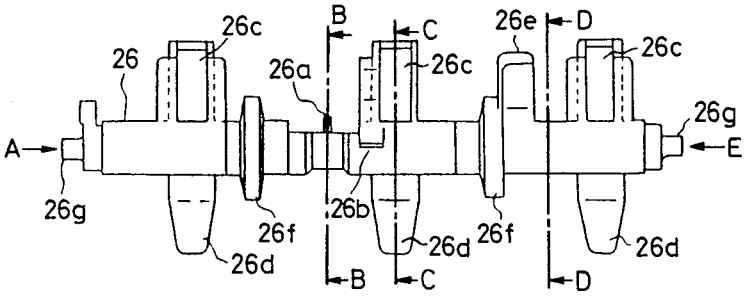
FIG. 43 is front view of a relay shaft.
Figure 44:
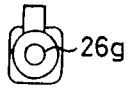
FIGS. 44 through 48 are views taken from the direction of the arrow A, B—B sectional view, C—C sectional view, D—D sectional view and a view taken from the direction of the arrow E, from FIG. 43, respectively.
Figure 45:
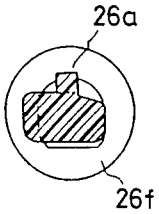
Figure 46:
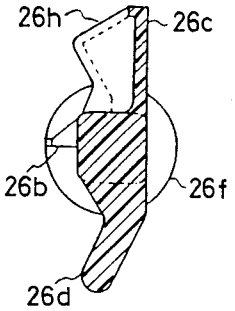
Figure 47:
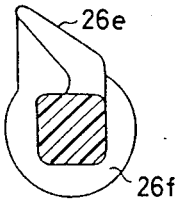
Figure 48:
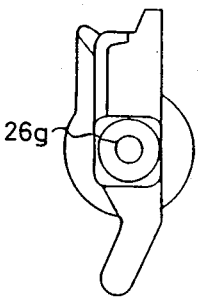
Figure 49:
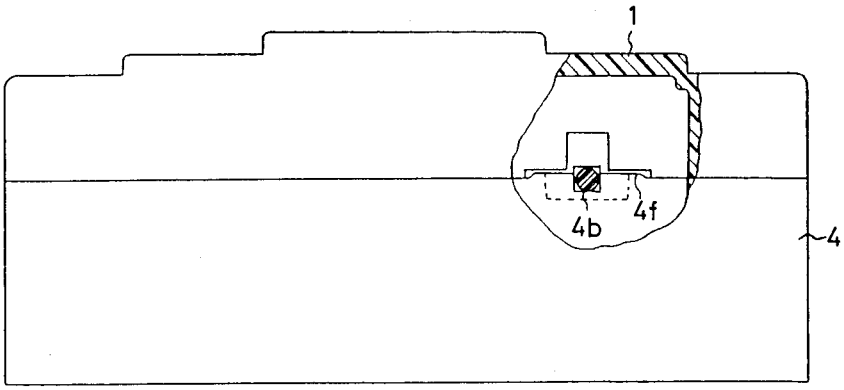
FIG. 49 is cross section of the case and cover and the part which holds the relay shaft.

FIGS. 37, 38 and 43 through 48 show the shape of the relay shaft 26 in this embodiment. The relay shaft 26 in this embodiment is integrally molded from a resin. As shown in FIGS. 28 and 43, a butt portion 26*c* for the bimetal 48 and a butt portion 26*d* for the moving core 15 are formed for each phase. Furthermore, an engagement portion 26*a* with the trip metal 29 is formed substantially at the center as shown in FIGS. 37 and 45 while an engagement portion 26*b* with the spring 30 is formed likewise at the center as shown in FIGS. 46 and 37. Another engagement portion 26*e* with a manual trip button (not shown) disposed on the cover is formed as shown in FIG. 47.

Insulating portions 26*f* are formed between the adjacent phases. Since the relay shaft is integrally molded in accordance with this embodiment, errors of angles do not occur between the butt portion 26*c* with the bimetal 48, the butt portion 26*d* with the moving core 15 and the engagement portion 26*a* with the trip metal 29, respectively, and the tripping operation can be effected accurately for each phase. Since the insulating portions 26*f* are also molded integrally, no gaps develop between the insulating portion and the shaft portion, and hence the insulation resistance does not drop.

The section of the shaft is substantially square except for its part at ends 26*g* in order to facilitate checking of the relation of angle for each portion. Both end portions 26*g* of the shaft are round to facilitate the rotation of the shaft. The bearing portions 4*b* (FIG. 49) of the relay shaft 26 are formed on both inner side surfaces of the casing 4, and a slope is formed on the bottom surface of each bearing portion 4*b* in order to prevent accidental tripping of the circuit breaker due to impact or the like.

The fitting position of the relay shaft 26 changes with the kind of circuit breakers and along therewith, the dimension from the upper surface of the casing 4 to the bottom of the bearing portion 4*b* mostly changes. As a result, the number of molds will become extremely great if different molds for the bearing portion 4*b* are produced for each model in accordance with the kinds of circuit breakers.

This embodiment makes it possible to use a common mold with other models by forming a second surface 4*f*, which is in agreement with the reference line of the mold, on the upper surface of the casing 4 so that the dimension from the reference line of the mold to the bottom of the bearing portion 4*b* is constant. The second surface 4*f* projects upward from the upper surface of the casing 4 in this embodiment. However, if the reference line of the mold is below the upper surface of the casing, a recess may be formed as the second surface 4*f* on the upper surface of the casing 4.

Figure 52:
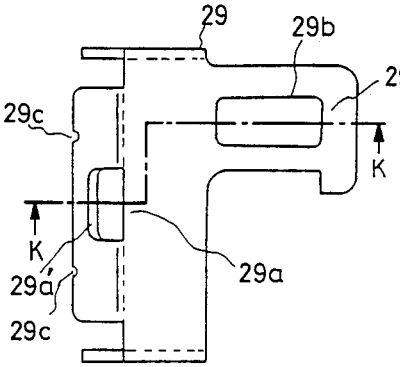
FIGS. 52 and 53 are plan and K—K sectional (from FIG. 52) views of the trip metal; respectively
Figure 53:
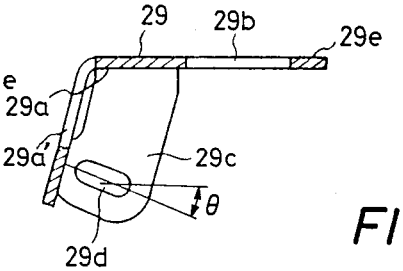

The trip metal 29 is equipped with the engagement portion 29*e* engaging with the engagement portion 26*a* of the relay shaft 26 at one of the ends of the upper surface as shown in FIGS. 37, 52 and 53. It is also equipped with a tripping portion 29*b* in the proximity of the engagement portion 29*e*. The tripping portion 29*b* in this embodiment is an opening. The other end of the trip metal is bent, and the engagement portion 29*c* with the spring 30 is formed at the tip of the bent portion. The engagement portion 29*a* with the hook 32 (FIGS. 28 and 56) and an escape hole 29a' are also formed in the proximity of the bent position. The hole 29d through which the shaft 59 is inserted is bored on the side portion 29c of the trip metal 29.

Figure 60:
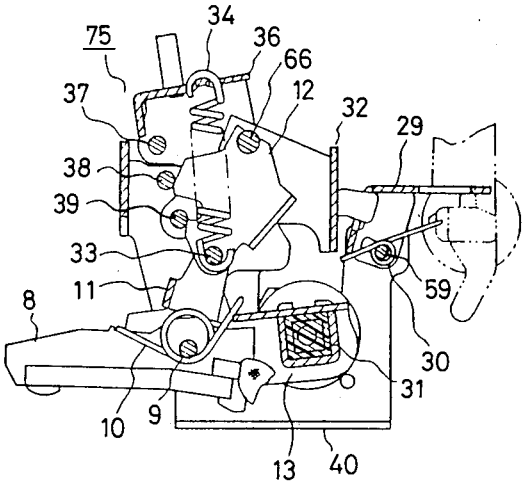
FIG. 60 is a sectional view of the switching mechanism.
Figure 61:
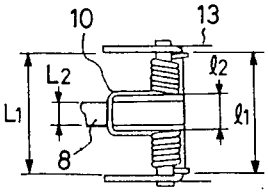
FIGS. 61 through 64 are plan views showing the modified examples of the shapes of a spring.
Figure 62:
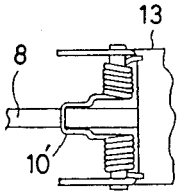
Figure 63:
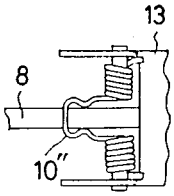
Figure 64:
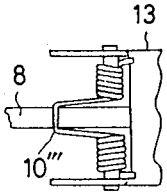

The trip metal 29 is rotatably supported on the fixed frame 40 by the shaft 59 which is rotatably inserted into the hole 29d as shown in FIG. 60, and its engagement portion 29e engages with, and is supported by, the engagement portion 26a of the relay shaft. The spring 30 consisting of a twist spring is fitted about the shaft 59. One of the ends of this spring 30 is anchored to the anchor portion 29c of the trip metal 29 while the other engages with the engagement portion 26b of the relay shaft 26. Therefore, the spring 30 urges the trip metal 29 in a direction in which the engagement portion 29e pushes the engagement portion 26a and prevents the circuit breaker from being tripped accidently.

Figure 57:
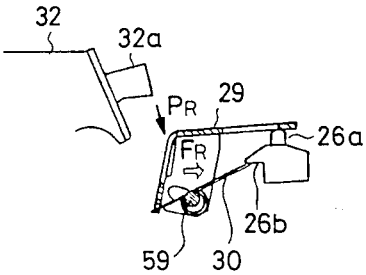
FIG. 57 is a sectional view showing the reset force at the time of resetting.
Figure 58:
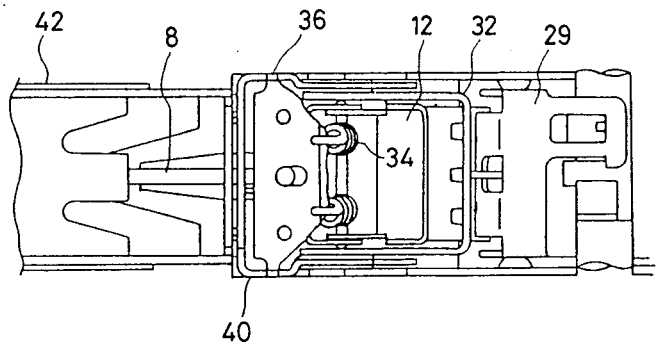
FIGS. 58 and 59 are plan and side views showing the construction of the switching mechanism.
Figure 59:
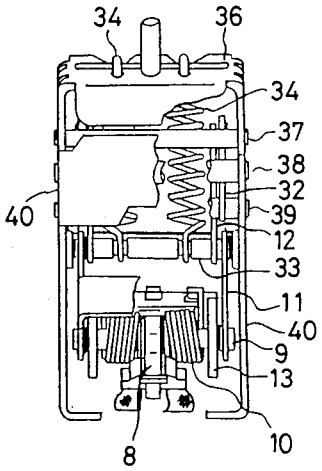

As shown in FIG. 53, the hole 29d formed on the side portion 29c has an oval shape and the center line in the direction of its major axis describes an angle $\theta$ with a line which is parallel to the upper surface of the trip metal. If the $\theta$ value is great, the moving quantity in the horizontal direction becomes small so that the engagement portion 26a does not easily come off from the engagement portion 29e and hence, accidental tripping is unlikely to occur. However, the force $F_R$ necessary for the movement of the trip metal 29 in the horizontal direction with respect to the movement of the hook 32 in the direction of an arrow $P_R$ at the time of the reset operation is great and the escape margin of the trip metal is small as shown in FIG. 57 so that a problem will occur in the reset operation.

If the value of $\theta$ is reduced, the force $F_R$ necessary for the movement of the trip metal in the horizontal direction at the time of resetting is small and the escape margin is great so that the reset operation is easier, but since the engagement portion 26a is likely to come off from the engagement portion 29e, accidental tripping is more likely to occur.

Figure 55:
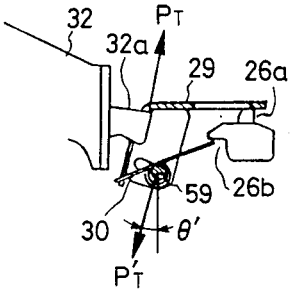
FIG. 55 is a sectional view showing the relation of the trip force of the hook and its reaction.
Figure 56:
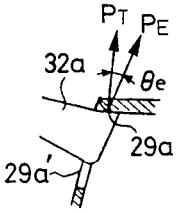
FIG. 56 is a sectional view showing the change of the direction of the line of force when the trip metal is worn out.

A force $P_T$ in FIG. 55 is applied to the trip metal 29 at an angle $\theta'$ with respect to the perpendicular due to the movement of the hook 32 in its releasing direction, so that a reaction $P'_T$ which is parallel, but is opposite in direction, to $P_T$ is applied to the shaft 59. If $\theta'$ becomes greater than $\theta$, the horizontal component of $P'_T$ becomes greater than the perpendicular component, so that the trip metal is more likely to move in the horizontal direction and accidental tripping due to impact or the like is more likely to occur. This occurs because, as shown in FIG. 56, the engagement surface of the trip metal 29a with the engagement portion 32a is worn and the direction of the line of force $P_T$ varies by an angle $\theta_e$ and changes to the line of force $P_E$, whereby the sum of $\theta'$ and $\theta_e$ is greater than $\theta$. Therefore, if the $\theta$ value is small, accidental tripping due to the causes described above is likely to occur.

Figure 54:
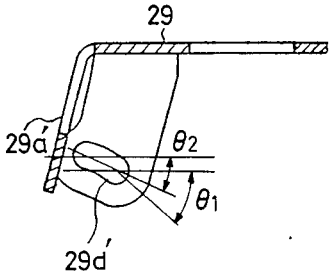
FIG. 54 is a K—K sectional view taken in FIG. 52 showing a modified example of a hole shape.

These contradictory problems can be solved by finding out a suitable $\theta$ value, but is also possible to shape the hole, into which the shaft 59 is inserted, in a bent oval hole 29d' shown in FIG. 54. In other words, the center line of the oval hole 29d' in its longitudinal direction describes an angle $\theta_2$ on the side close to the escape hole 29a' and $\theta_1$ on the side away from the escape hole 29a' with respect to a line which is parallel to the upper surface of the trip metal, whereby these angles satisfy the relation $\theta_1 > \theta_2$. This arrangement reduces the force necessary for the movement of the trip metal in the horizontal direction, and makes it difficult for the accidental tripping to occur because the degree of movement is restricted.

Figure 50:
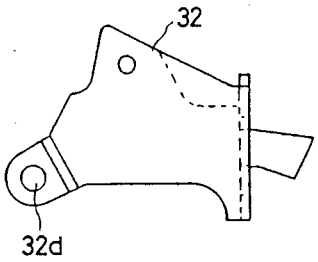
FIGS. 50 and 51 are side and front views of the hook.

The hook 32 is molded in a substantially U-shaped form, and holes 32d for inserting the shaft 39 are bored on both sides of the U-shape as shown in FIG. 50. The hook 32 is rotatably supported by the shaft 39 to the fixed frame 40. The engagement portion 32a of the hook 32 is formed on the bottom of the U-shape so as to engage with the trip metal 29. In this embodiment, since the engagement portion 32a is formed by being partially cut away from and raised from the surface of the metal, an opening 32b is formed on the bottom of the U-shape. According to this embodiment, since the engagement portion 32a is formed by being partially cut away from and raised from the surface of the metal, the material can be utilized effectively and the weight of the hook can be reduced.

Figure 51:
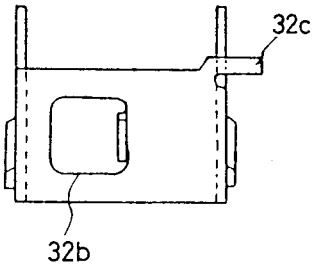

An operating lever portion 32c is formed in such a manner as to project from the extension portion of the bottom as shown in FIG. 51 in order to drive accessorial devices such as an auxiliary switch, an alarm switch, and so forth. Since this embodiment uses the movement of the hook for driving the accessorial devices, the rotation of the relay shaft 26 and the releasing operation of the moving contactor 8 are not prevented and the accessorial devices can be driven with a suitable force.

In the tripping mechanism having the construction described above, when at least one of the bimetal 48, the moving core 15 and the manual trip button (not shown) is operated, the relay shaft 26 rotates in a direction in which the engagement portion 26a moves towards the tripping portion 29b of the trip metal 29, thereby releasing the engagement between the engagement portion 26a and the engagement portion 29e of the trip metal 29. The trip metal 29 is then rotated in a direction in which its engagement portion 29e comes close to the relay shaft 26 with the shaft 59 being the center, by the spring 30. Therefore, the engagement portion 32a of the hook 32 is disengaged from the engagement portion 29a of the trip metal 29, and the hook 32 is urged by the spring 34 and is rotated upward with the shaft 39 being the center, thereby causing the tripping operation.

FIGS. 58 through 71 show the switching mechanism in this embodiment. The switching mechanism consists of a handle lever 36 which has an engagement portion with the handle 35 on its upper surface and whose lower end is pivotally supported to the fixed frame 40 by shaft 37; a hook 32 which is rotatably supported by the shaft 39 to the fixed frame 40; an upper lever 12 whose one end is rotatably supported by the shaft 66 to the hook 32 and whose other end is connected to the lower lever 11 through the shaft 33; a spring 34 which is stretched between the shaft 33 and the handle lever 36; a lower lever 11 whose one end is rotatably supported by the shaft 33 to the upper lever 12 and whose other end is rotatably supported by the shaft 9 to the moving frame 13 and the moving contactor 8; a stopper shaft 38 of the upper lever 12 which is pivotally supported to the fixed frame 40; and a moving frame 13 whose one end is fixed to the shaft 31 and whose other end is rotatably supported by the shaft 9 to the moving contactor 8.

The moving contactor 8 obtains a contact pressure with the fixed contactor from the spring 10 which is wound on the shaft 9. The spring 10 in this embodiment is a twist spring which is constituted such that both its end portions engage with the moving frame 13 and its center urges the moving contactor 8. The spring is set in such a manner as to satisfy the relations $l_1 \geqq L_1$ and $l_2 \leqq L_2$ where $L_1$ is the width of the moving frame, $L_2$ is the width of the moving contactor, $l_1$ is the entire width of the spring and $l_2$ is the width of the narrowest portion at the center of the spring. According to this arrangement, the moving contactor 8 is clamped at the center of the spring 10, and any deviation of the moving contact to the right and left can be effectively prevented. The shape of the spring may be the shape of the spring 10' shown in FIG. 62, the shape of the spring 10'' shown in FIG. 63 or that of the spring 10''' shown in FIG. 64.

Figure 65:
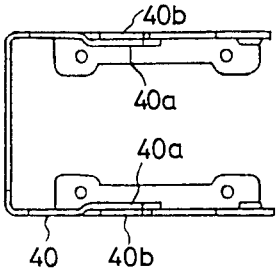
FIG. 65 is a plan view of the fixed frame.

The fixed frame 40 has a substantially U-shaped cross-section as shown in FIG. 65, and the stopper portion 40*a* for the shaft 33 and the pivot portion 40*b* for the handle lever 36 are formed on each side of the U-shape.

Figure 66:
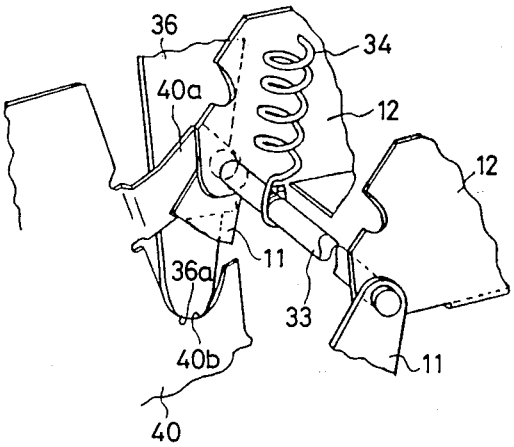
FIG. 66 is a perspective view showing the state in which the handle lever is mounted to the fixed frame and the lever shaft is held.
Figure 67:
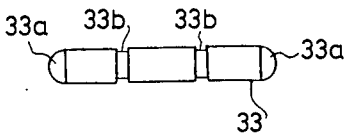
FIG. 67 is a plan view showing the shape of the lever shaft.
Figure 68:
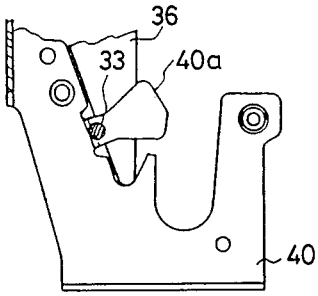
FIGS. 68 through 71 are side views showing the positions of the lever shaft at the time of ON, OFF, trip and reset.
Figure 69:
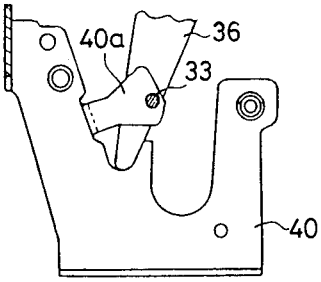
Figure 70:
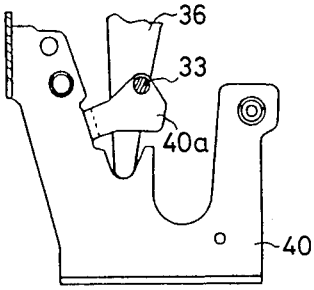

FIG. 66 is a perspective view showing the engagement state between the fixed frame 40, the handle lever 36 and the shaft 33. The stopper 40a is provided with a minimum necessary shape capable of guiding the end surface of the shaft 33 in any of the states ON, OFF, trip and reset, and in the shift process from any one of these four states to any other. The stopper portion 40*a* is formed in such a manner as to project inward from the frame in a distance corresponding to the thickness of the fixed frame, and thus to function as the guide for the handle lever 36. An engagement groove 33*b* of the spring 34 is formed on the shaft 33 as shown in FIG. 67. The end surface 33*a* of the shaft 33 may be left as cut, but if it is a spherical surface as shown in the drawing, the shaft 33 and the stopper portion 40*a* establish a point contact between them and the operation becomes consequently smoother.

FIGS. 68 through 71 show the positions of the shaft 33 in the ON, OFF, trip and reset states, respectively. In this embodiment, the stopper portion 40*a* has a substantially arcuate form with its connection portion with the fixed frame 40 being the center, and restricts the lateral movement of the shaft 33 at each of the ON, OFF, trip and reset portions. Furthermore, since the stopper portion 40*a* in this embodiment is disposed at the minimum necessary portion, the weight of the fixed frame 40 can be reduced. It is also possible to fabricate the stopper portion 40*a* in a separate piece and to fix it to the fixed frame 40 by spot welding or the like. In this embodiment, since the handle lever 36 comes on the reverse side of the contact surface of the shaft 33 with respect to the stopper portion 40*a*, any deformation of the stopper portion 40*a* can be prevented even when impact or the like in the horizontal direction acts upon the stopper portion 40*a*.

The handle lever 36 is pivotally supported by the fixed frame 40 as the curved portion 36*a* formed at the tips of both sides of the U-shape engage with the pivot portions 40*b* of the fixed frame 40. The movement of the handle lever 36 in the transverse direction is limited by the stopper portion 40*a*, and the fall-off of the curved portion 36*a* from the pivot portions 40*b* is prevented. In this embodiment, the width of the fixed frame 40 can be made equal to that of the handle lever 36, so that the width of the circuit breaker can be reduced.

In this embodiment, the fixed frame 40 is disposed at the center phase and is positioned substantially at the center inside the casing 4. The switching operation of the moving contactor 8 due to the operation of the switching mechanism is transmitted to the moving contactor of the adjacent phase through the shaft 31.

What is claimed is:

1. A circuit breaker, comprising:

a J-shaped fixed contactor in circuit;

a moving contactor in circuit a connection terminal electrically connected to one of said contactors;

a fixed core in circuit;

a switching mechanism for switching said moving contactor into and out of engagement with said fixed contactor;

a heater disposed electrically in circuit in series between said one contactor and said terminal in such a manner as to extend along said fixed core;

a moving core rotatably supported relative to said fixed core to move toward said fixed core upon current overload to actuate said switching mechanism;

an insulating member disposed in such a manner as to extend on the outer side of said fixed contactor facing said moving contactor;

a demagnetizer member disposed in such a manner as to extend along an inner side of the J-shape of the said fixed contactor; and means interconnecting said insulating member and said demagnetizing member in such a manner as to clamp said fixed contactor between them.

2. A circuit breaker according to claim 1 wherein said fixed contactor includes an arc runner at the tip of the J-shape, and said arc runner is disposed at a downward angle from a horizontal direction.

3. A circuit breaker according to claim 1 wherein said fixed core is formed in a U-shape, a projection is formed at the center of the inner surface of the U-shape, and said heater is fixed to said projection.

4. A circuit breaker according to claim 1, wherein said switching mechanism includes:

a fixed frame;

a handle lever movably mounted to said fixed frame;

a trip metal;

a hook engaging with the trip metal and causing a tripping operation;

a link member consisting of an upper level and a lower level and interposed between said hook and said moving contactor;

a lever shift pivotally supporting said upper and lower levers; and a spring stretched between said lever shaft and said handle lever;

said handle lever formed substantially in a U-shape and having arcuate portions at the tips of both sides of the U-shape;

said fixed frame having bearing portions coming into contact with said arcuate portions and pivotally supporting said handle lever, and a guide portion guiding the end surface of said lever shaft.

5. A circuit breaker according to claim 4 wherein said fixed contactor has an arc runner disposed at the tip of the J-shape at a downward angle from a horizontal direction; said fixed core is formed in a U-shape and has a projection at the center of the inner surface of the U-shape in order to fix said heater.

6. A circuit breaker according to claim 4, operation time adjusting means disposed in such a manner as to engage with said moving core and to adjust the operation time of said moving core; and a casing constituted in such a manner as to store therein all of said members described above;

said operation time adjusting means coming into contact with an adjustment portion disposed on said moving core and detachably fitted to said casing;

a trip lever;

said fixed core being formed in a U-shape and having a projection at the center of the inner surface of the U-shape in order to fix said heater;

said insulating member and said demagnetizing member being constituted in such a manner as to interpose said fixed contactor between them;

said operation time adjusting means coming into contact with an adjustment portion disposed on said moving core, and detachably fitted to said casing.

7. A circuit breaker according to claim 1, further comprising:

an insulating enclosure housing said contactors;

a plurality of vertically stacked metallic arc plates spaced from each other and each having a generally V-shaped notch cut therein along one edge thereof and being positioned so that said moving contactor is movable along a path within said V-shaped notches;

said V-shaped notches defining an arc chute and having adjacent notches horizontally offset with respect to each other so that the arc is caused to run a zig zag path within the arc chute for increasing the arc length and increasing the arc suppression effect.

8. The circuit breaker according to claim 7, wherein adjacent arc plates are mirror images of each other.

9. A circuit breaker according to claim 1, further comprising:

an insulated enclosure housing therein said fixed contactor and said moving contactor;

said switching means producing an arc and associated arc gases; and said insulating enclosure having surfaces adjacent said contactors that have therein slot means extending across their surface exposed to the gases so that metallic deposits from the arced gases will be interrupted by said slot means in their electrical conductivity.

10. A circuit breaker according to claim 1, further comprising:

a flexible conductor electrically connected between said connection terminal and said moving contactor; and magnetic wire means wound around said flexible conductor close to the connection portion of the flexible conductor with the moving contactor to prevent breakage of the flexible conductor during repeated bending during the switching operations.

11. A circuit breaker according to claim 1, further comprising:

an insulating casing;

a shaft pivotally mounting said moving contactor to said casing; and a bent wire spring surrounding said shaft, and being symmetrical on opposite sides of a central portion engaging said moving contactor at a position radially spaced from the axis of said shaft, said spring having outwardly radially extending terminal end operating portions, coiled portions extending inwardly from each of said terminal end portions and being coiled about said shaft, and radially extending central portions on each side of said moving contactor extending between the inner end of said coiled portions and the spring portion engaging said moving contactor, the axial distance between the radially inner ends of said radially extending contact portions is greater than or equal to the axial width of said moving contactor therebetween.

12. A circuit breaker according to claim 11, including a moving frame pivotally mounted directly on said casing and supporting thereon said shaft in spaced relationship to the pivotal axis of said moving frame to said casing; the terminal end operating portions of said spring engaging with said moving frame, and the moving frame being generally U-shaped, with its legs being pivotally connected to said shaft and passing therethrough said shaft with a spacing between the inner portions of said legs being greater than or equal to the maximum spacing between the terminal end portions of said spring.

13. A circuit breaker according to claim 1, further comprising:

a shaft mounted to said casing;

a trip being constructed in a generally U-shape of bent sheet metal and having elongated apertures in the leg portions of said U-shape that receive therein said shaft for pivotally mounting said trip metal, said apertures having a width substantially equal to the diameter of said shaft and a length substantially longer than said width, and said apertures being of arcuate shape to provide a resetting slot portion with one angle of inclination and a tripping slot portion with a different angle of inclination.

14. A circuit breaker, comprising:

a fixed contactor in circuit;

a moving contactor in circuit;

a connection terminal electrically connected to one of said contactors;

a fixed core in circuit;

a switching mechanism for switching said moving contactor into and out of engagement with said fixed contactor;

a heater disposed electrically in circuit in series between said one contactor and said terminal in such a manner as to extend along said fixed core;

a bimetallic member;

means mounting one end portion of said bimetallic member to one end portion of said core with one portion of said heater therebetween, said portions of said heater and bimetallic member being in heat conductive contact, the remainder of said bimetallic member other than said end portion being spaced from and out of heat conductive contact with the adjacent spaced from and out of heat conductive contact with the adjacent portion of said heater, the remaining portions of said core other than said end portion being spaced from and out of heat conductive contact with said heater, and the major portions of said core and bimetallic member being generally coextensive, spaced from and parallel to each other with said heater therebetween and with said heater in spaced apart generally parallel relationship to each of said core and said bimetallic member;

a moving core rotatably supported relative to said fixed core to move toward said fixed core upon current overload to actuate said switching mechanism;

operation time adjusting means disposed in such a manner as to engage with said moving core and to adjust the operation time to said moving core;

a casing constituted in such a manner as to store therein said contactors, mechanism, heater, core and means; and said operation time adjusting means coming into contact with an adjustment portion disposed on said moving core and detachably fitted to said casing.

15. A circuit breaker according to claim 14 wherein said fixed contactor is formed in a J-shape, and an insulating member and a demagnetizing member are disposed in such a manner as to extend along the side of said fixed contactor facing said moving contactor and along the inner surface of the J-shape, respectively and to interpose said fixed contactor between them.

16. A circuit breaker according to claim 14 wherein said switching mechanism includes:

a fixed frame;

a handle lever movably mounted to said fixed frame;

a trip metal;

a hook engaging with the trip metal and causing a tripping operation;

a link member consisting of an upper lever and a lower lever and interposed between said hook and said moving contactor;

a lever shaft pivotally suppoting said upper and lower levers; and a spring stretched between said lever shaft and said handle lever;

said handle lever formed substantially in a U-shape and having arcuate portions at the tips of both sides of the U-shape;

said fixed frame having bearing portions coming into contact with said arcuate portions and pivotally supporting said handle lever, and a guide portion guiding the end surface of said lever shaft.

17. A circuit breaker according to claim 14 wherein said fixed contactor is formed in a J-shape, and an insulating mmember annd a demagnetizing member are disposed in such a manner as to extend along the side of said fixed contactor facing said moving contactor and along the inner surface of the J-shape, respectively, and to interpose said fixed contactor between them, and said switching mechanism includes:

a fixed frame;

a handle lever movably mounted to said fixed frame;

a trip metal;

a hook engaging with the trip metal and causing a tripping operation;

a link member consisting of an upper lever and a lower lever and interposed between said hook and said moving contactor;

a lever shaft pivotally supporting said upper and lower levers; and a spring stretched between said lever shaft and said handle lever;

said handle lever formed substantially in a U-shape and having arcuate portions at the tips of both sides of the U-shape;

said fixed frame having bearing portions coming into contact with said arcuate portions and pivotally supporting said handle lever, and a guide portion guiding the end surface of said lever shaft.

18. A circuit breaker, according to claim 14, further comprising:

said heater being a generally inverted U-shaped heater of bent sheet metal having one leg connected to said connection terminal at its outer end; the outer end of the other leg of said heater being offset outwardly from the remaining portion of said other leg to provide an offset mounting portion;

said bimetallic member being elongated and straight, and having one end engaging and connected to said offset mounting portion of said heater and extending in spaced parallel relationship to the remaining portion of said heater other leg to the outside of said heater; and said fixed core being of generally plate shape having an offset mounting portion offset to a greater extent that the offset of the offset mounting portion of said heater, said fixed core offset portion engaging and being mounted to the offset mounting portion of said heater on the opposite side from said bimetallic member and the major portion of said fixed core extending parallel to and spaced from the inner surface of the remaining portion of said other leg of said heater.

19. A circuit breaker according to claim 18, wherein said heater has at least one through hole in the bent portion between said offset portion and the remainder of said heater for relieving strain.

20. A circuit breaker according to claim 14, said casing being a molded insulated member having a reduced thickness wall portion with means to facilitate breaking out the wall portion to provide a mounting opening;

said casing being constructed in at least two parts relatively movable to permit mounting said operating time adjusting means within said casing;

said operating time adjusting means having a manually adjustable knob extending through said opening in said casing when said time adjustment means is mounted within said casing.

21. A circuit breaker according to claim 20, wherein said casing has two parallel rectilinear slot means opening freely outward when said casing parts are separated, and said operating time adjusting means having two rigidly interconnecting wall portions spaced apart and located to be assembled within said slot means for mounting said operating time adjusting means within said casing.

22. A circuit breaker according to claim 21, wherein said wall portions of the operating time adjusting means are constructed of sheet metal and have cut out portions that will dig into the slots of said casing and securely hold said operating time adjusting means within said casing.

23. A circuit breaker, comprising:

a J-shaped fixed electrical contactor having a first leg including a current direction reversing portion, and a second leg;

a moving electrical contactor facing said first leg and disposed to conduct a flow of electrical current in a first direction opposite to a second direction of said current flowing through said current direction reversing portion; and a demagnetizing member disposed to extend along said current direction reversing portion between said first leg and said second leg;

whereby said moving electrical contactor is driven to open a circuit including said fixed and moving electrical contactors by electromagnetic repulsion forces occurring between said moving electrical contactor and said first leg due to overcurrent, and said demagnetizing member absorbs magnetic flux generated by electrical current flowing through said second leg to prevent reduction of the repulsion forces.

24. A circuit breaker according to claim 23, further comprising:

an insulating member disposed to extend to the outer side of said J-shaped fixed electrical contactor facing said moving electrical contactor; and said insulating member having means for interconnecting with said demagnetizing member, said demagnetizing member being inserted into said interconnecting means to clamp said first leg between said demagnetizing member and said insulating member.

* * * * *